US006790096B2

(12) United States Patent
Lin

(10) Patent No.: US 6,790,096 B2
(45) Date of Patent: Sep. 14, 2004

(54) CABLE ASSEMBLY HAVING ARRANGEMENT FOR ORGANIZING CABLE

(75) Inventor: Yuan-Chieh Lin, Lake Forest, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 93 days.

(21) Appl. No.: 10/188,544

(22) Filed: Jul. 3, 2002

(65) Prior Publication Data

US 2003/0124904 A1 Jul. 3, 2003

Related U.S. Application Data

(63) Continuation-in-part of application No. 29/153,374, filed on Dec. 28, 2001, now Pat. No. Des. 473,520.

(51) Int. Cl.[7] ..... H01R 24/00

(52) U.S. Cl. ..... 439/676

(58) Field of Search ..... 439/676, 108, 439/502, 607, 610, 608, 668, 557

(56) References Cited

U.S. PATENT DOCUMENTS 5,304,069 A * 4/1994 Brunker et al. ..... 439/108
2002/0031955 A1 * 3/2002 Schmidt et al. ..... 439/676
2003/0096536 A1 * 5/2003 Clark et al. ..... 439/676

* cited by examiner

*Primary Examiner*—J. F. Duverne
(74) *Attorney, Agent, or Firm*—Wei Te Chung

(57) ABSTRACT

A cable assembly (1) includes a connector (2) and a cable (3) terminated with the connector. The connector includes a housing (20) having a main body (201) and a projecting portion (202) protruding from the main body, with a number of terminals (21) that are inserted into the housing. The projecting portion and the main body together define a cable exit channel (204) on an outer side of the housing. When a number of connectors of cable assembly are mated with counterpart connector side by side on a panel, a special cable exit directs the cable routed along the panel. This allows a) dense placement of the cable assemblies on and along a panel in a limited space, b) insertion or removal of a panel without interference by the cable assemblies on its adjacent panel and c) mating or un-mating a similar cable assembly or a number of similar cable assemblies from a panel without interference by the cable assemblies on its adjacent panel.

7 Claims, 14 Drawing Sheets

CABLE ASSEMBLY HAVING ARRANGEMENT FOR ORGANIZING CABLE

This is a continuation-in-part application of a application with a Ser. No. 29/153,374 filed Dec. 28, 2001, now U.S. Pat. No. D,473,520.

BACKGROUND OF THE INVENTION

1. Field of the Invention

The present invention relates to a cable assembly, and particularly to a cable assembly with a block such that the cable is well arranged by the block. When a plurality of cable assemblies are mounted to a panel, the blocks define an open channel together with the connector housing thereby the cables can be well organized within the open channel.

2. Description of Prior Art

Conventionally, a cable assembly includes a connector with a cable attached thereto. The cable is attached to the connector from a rear end of the connector. When a plurality of cable assemblies are mounted on a panel in-row, organization of the cable become an issue. Since the cable extends rearward, it can either shift to left or right. As such, it creates an issue in organizing the cables extend from the connectors.

A conventional cable connector, as disclosed in U.S. Pat. No. 5,785,555 and in U.S. patent application Ser. No. 2001/0023146 A1, is configured with a straight cable exit, in which a cable extends straight outwards from a back face of the cable connector. Obviously, such cable connectors can only be arranged side by side and a lot of space at the back of the connectors is occupied due to the rearwardly extending cables. Cable connector structures, such as that shown in U.S. patent application Ser. No. 2001/0046798 A1, require that the cable connectors be positioned vertically side by side, if adequate space for adjacent cable connectors is to be provided for, since the cables exit along a direction perpendicular to the mating face of the connectors. Als o, such cable connector structures bring a problem of cables organization and simultaneously waste a lot of space at a side thereof. U.S. Pat. No. 4,789,358 describes yet another type of cable connector, which has an angled cable exit and an external cable extending upwardly and rearwardly from the angled cable exit. Similarly, the external cables of such cable connectors cannot be well organized and such configurations also waste a lot of connection space at the back thereof.

All the above cable connectors have a same issue in that none of the cable exits effectively save the connection space and well organizes the corresponding cables so that none of the cable connectors allows an increase in density of cable connectors as arranged on a panel of an electronic device, while avoiding interference with neighboring cables. This problem is getting more important as the needs for higher density applications.

Hence, an improved cable assembly is required to overcome the disadvantages of the prior art.

BRIEF SUMMARY OF THE INVENTION

A first object of the present invention is to provide an improved cable assembly for mounting onto a panel, the cable assembly having a block to organize an outwardly extending cable.

A second object of the present invention is to provide a cable assembly, wherein multiple such cable connectors are arranged together only occupying a limited space.

A third object of the present invention is to provide a cable assembly, wherein the cables can be well organized when a plurality of such cable assembly are arranged on panels.

A cable assembly in accordance with the present invention includes a cable connector and an external cable terminated with the cable connector. The cable connector is mountable on a side of a panel for mating with a board mountable connector which is secured to an opposite side of the panel and is terminated onto an electronic card. The cable connector includes a dielectric housing having a main body and a projecting portion projecting outwards from a side of the main body. The main body defines a receiving space therein for receiving an end of a corresponding cable. The projecting portion forms a guiding face, which is slanted relative to the panel, and defines a cable exit channel on an outside of the dielectric housing between the guiding face and an outer side of the main body. An opening is defined through a bottom side of the projecting portion, through which the end of the cable is insertable into the receiving space of the dielectric housing. The cable connector has a plurality of terminals fixed in the dielectric housing, each being connected to a wire of the cable.

When plural cable connectors are assembled side by side and each has a cable extending therefrom, the cable which protrudes from the projecting portion of its associated cable connector is received in the cable exit channel of an adjacent cable connector, and extends along the guiding face of the adjacent cable connector. Therefore, the plurality of cables terminated by different cable connectors do not interfere with each other.

Furthermore, the cable connector has a central axis "A" normal to the panel, which defines an acute angle $\alpha$ with a central axis "B" of the associated cable attached thereto and is offset from the central axis "B" a predetermined distance "D" (FIGS. 4 and 5).

Other objects, advantages and novel features of the invention will become more apparent from the following detailed description of the present embodiment when taken in conjunction with the accompanying drawings.

DETAILED DESCRIPTION OF THE INVENTION

Figure 1:
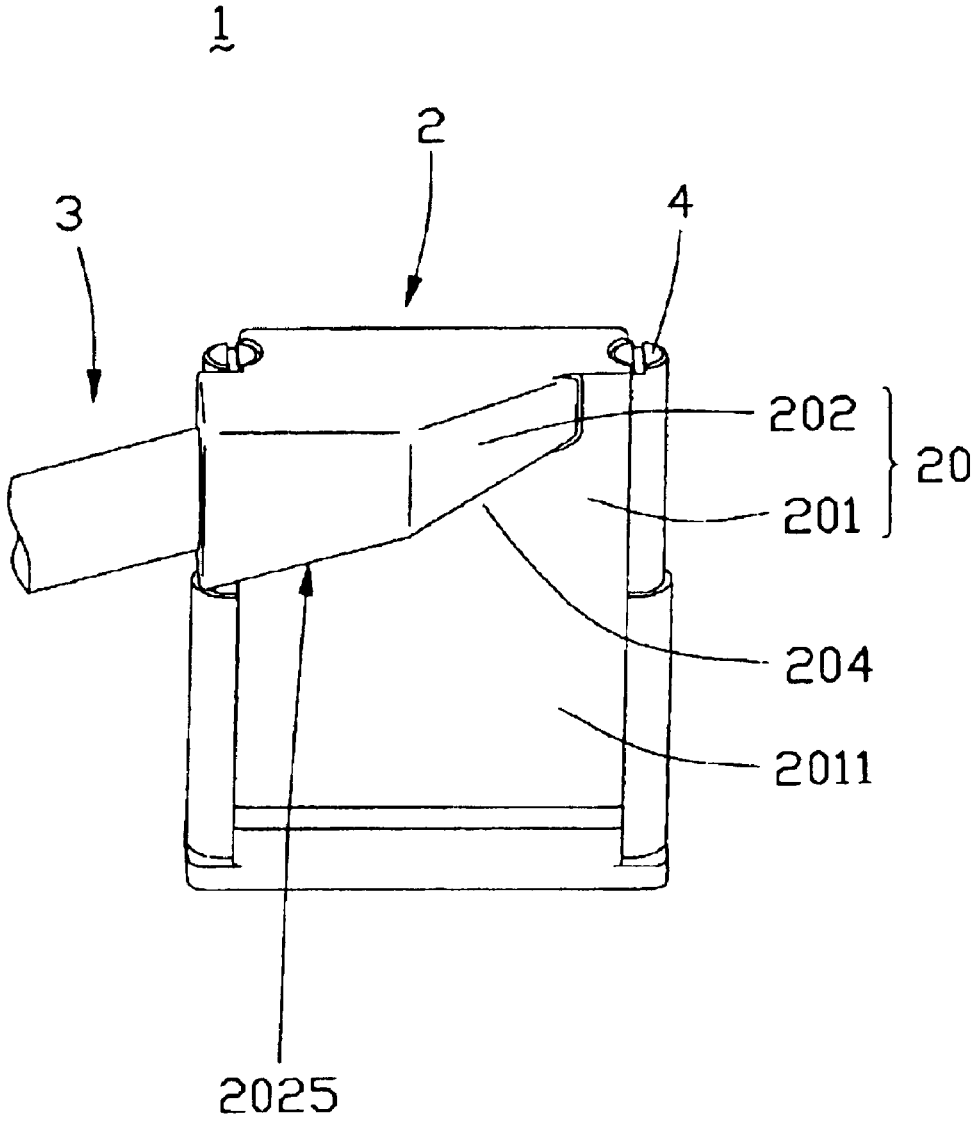
FIG. 1 is a perspective view of a cable assembly in accordance with the present invention.

Reference will now be made to the drawing figures to describe the present invention in detail.

Together referring to FIGS. 1–5, a cable assembly 1 in accordance with the present invention is illustrated. The cable assembly 1 comprises an electrical cable connector 2 and a cable 3 terminated with the cable connector 2 (or electrically connected thereto).

The cable connector 2 comprises a dielectric housing 20, a plurality of terminals 21 (FIG. 7) received in the dielectric housing 20 and a pair of screws 4 attached to opposite sides of the dielectric housing 20. The dielectric housing 20 includes a main body 201 configured in the shape of a rectangular box and defining a receiving space 2014 (FIG. 7) therein. A first wall 2011 forms a right side of the main body 201, and a projecting portion 202 protrudes outwards from a rear portion of the first wall 2011. The main body 201 also has a mating tongue 22 formed at a lower end thereof.

The projecting portion 202 of the cable connector 2 defines a chamber 2021 (FIG. 6) in communication with the receiving space 2014 of the main body 201 for receiving an end of the cable 3. An opening 2022 is defined in the projecting portion 202, which acts as an exit for the cable 3 from the receiving space 2014 of the main body 201. The projecting portion 202 has a guiding face 2025 obliquely formed on an outer side thereof. A cable exit channel 204 is defined between the guiding face 2025 and the first wall 2011.

Figure 6:
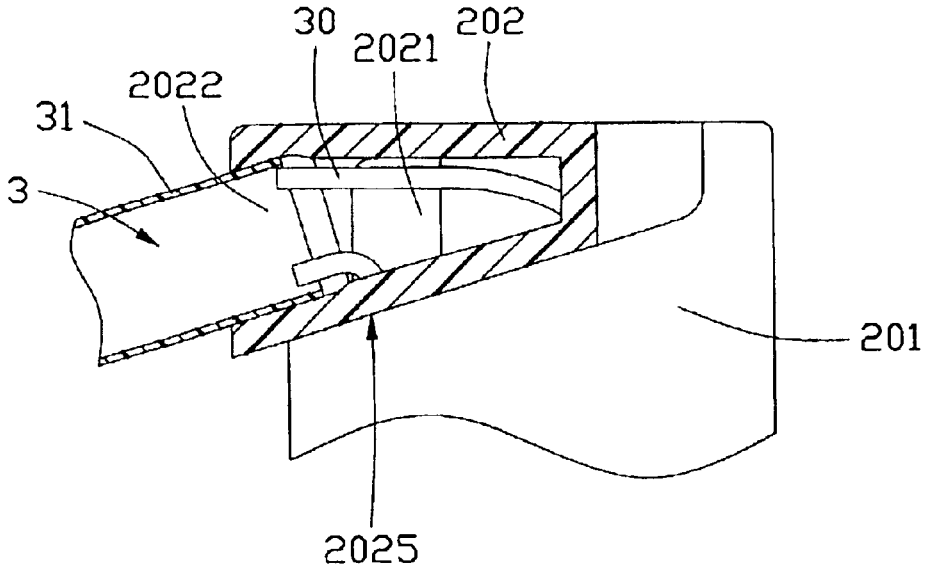
FIG. 6 is a partial, sectional view of the cable assembly shown in FIG. 4, illustrating an inside of a projecting portion thereof.
Figure 7:
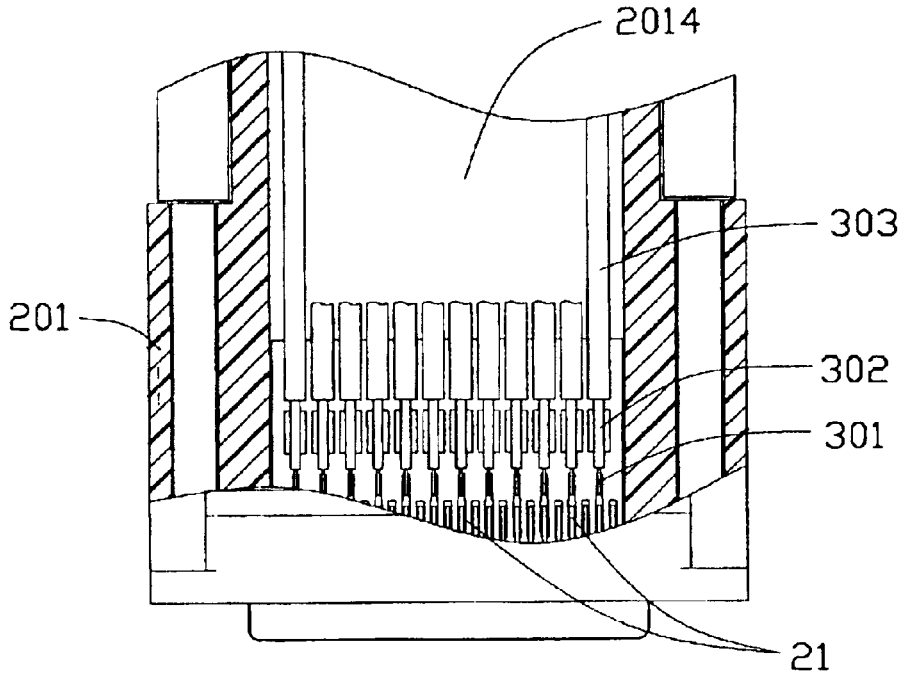
FIG. 7 is a partial, sectional view of the cable assembly shown in FIG. 4, illustrating wires of a cable connecting with terminals of a cable connector.
Figure 8:
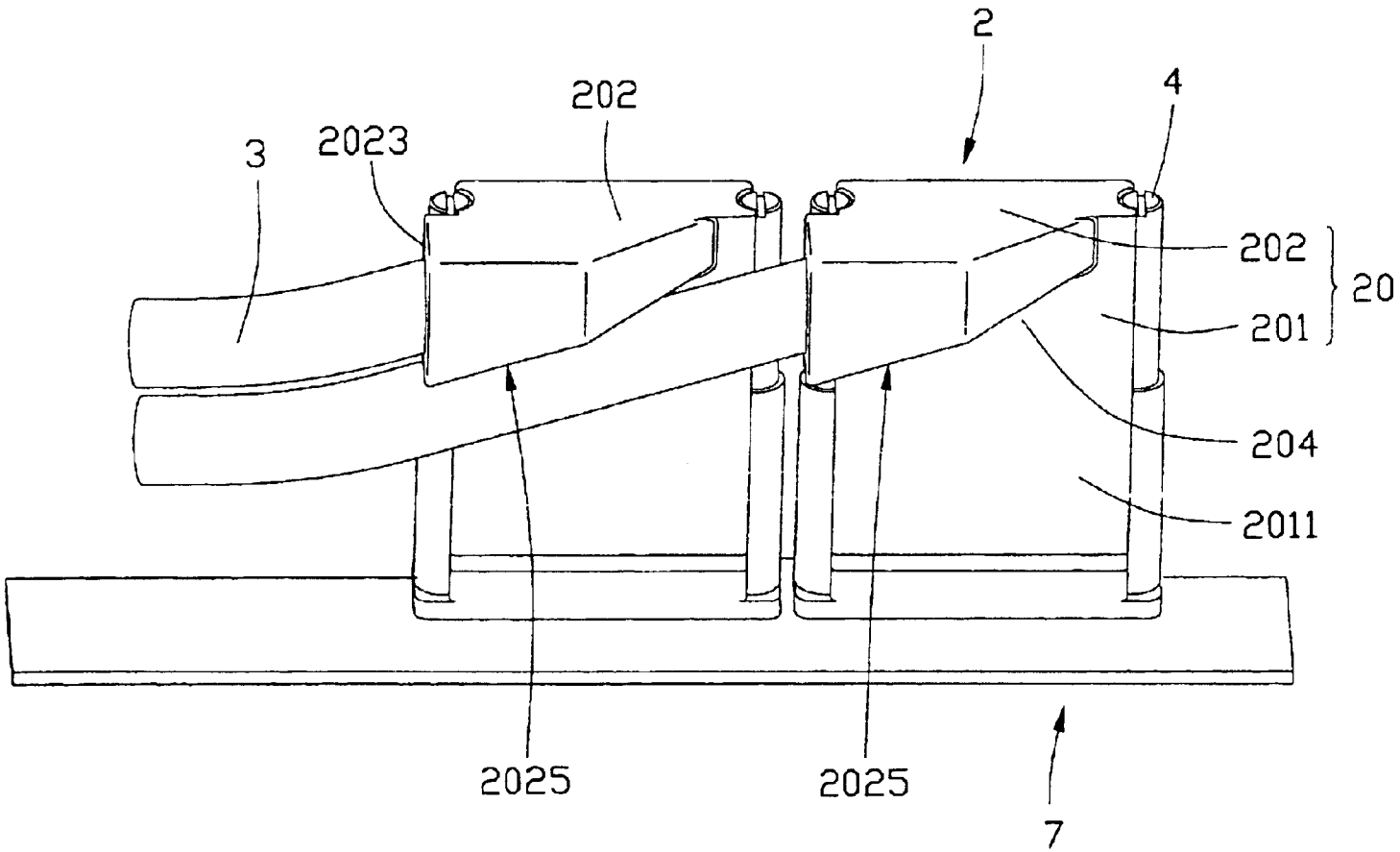
FIG. 8 is a perspective view of a pair of the cable connector assemblies which is side by side secured onto a panel.
Figure 9:
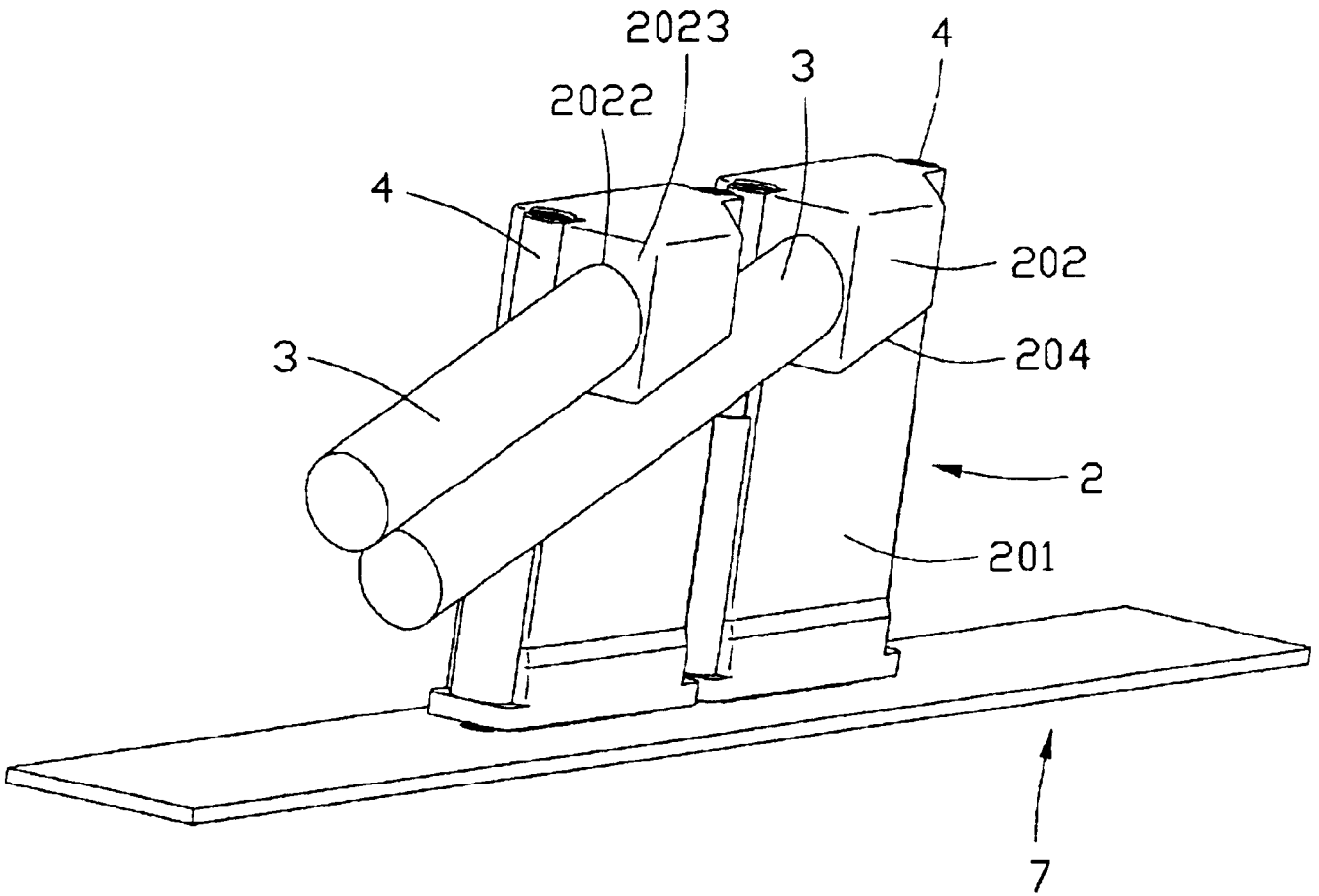
FIG. 9 is a view similar to FIG. 8 while viewed from a second direction.
Figure 10:
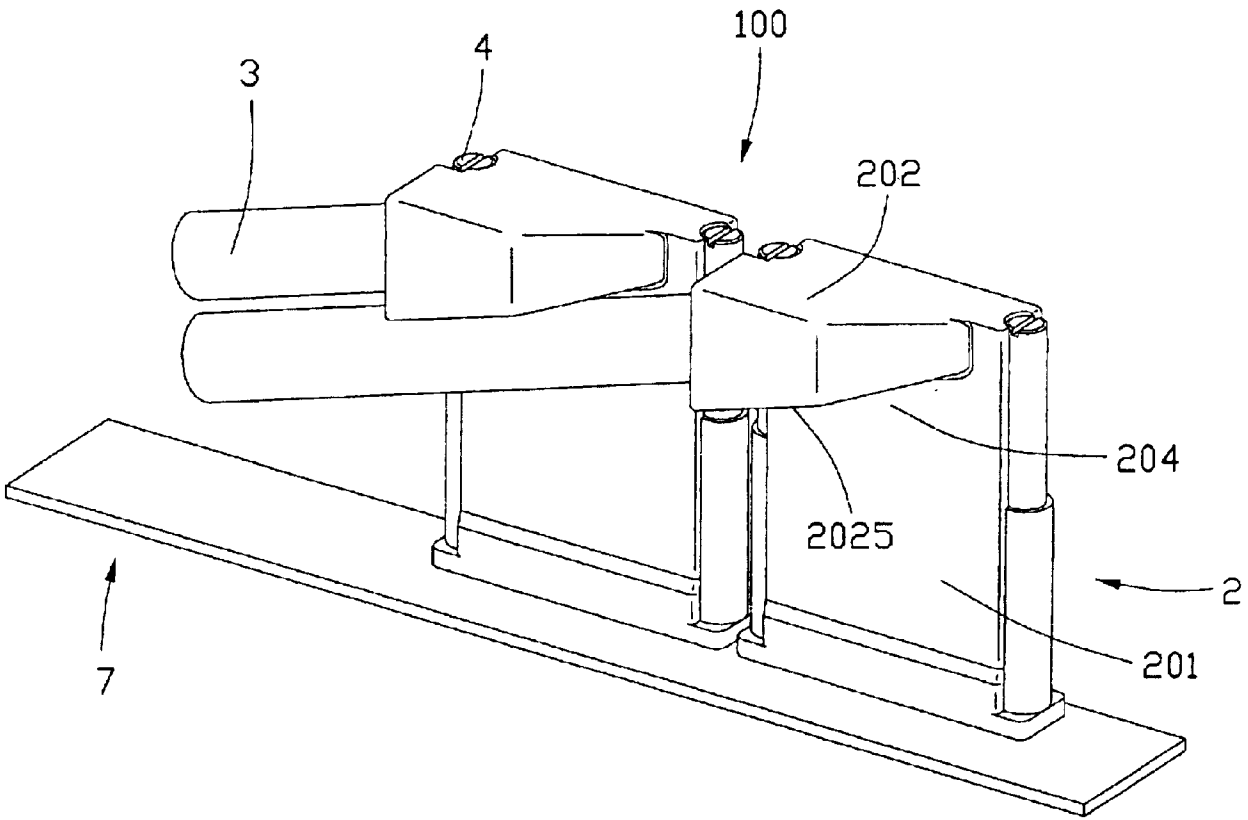
FIG. 10 is a view similar to FIG. 8 while viewed from a third direction.
Figure 11:
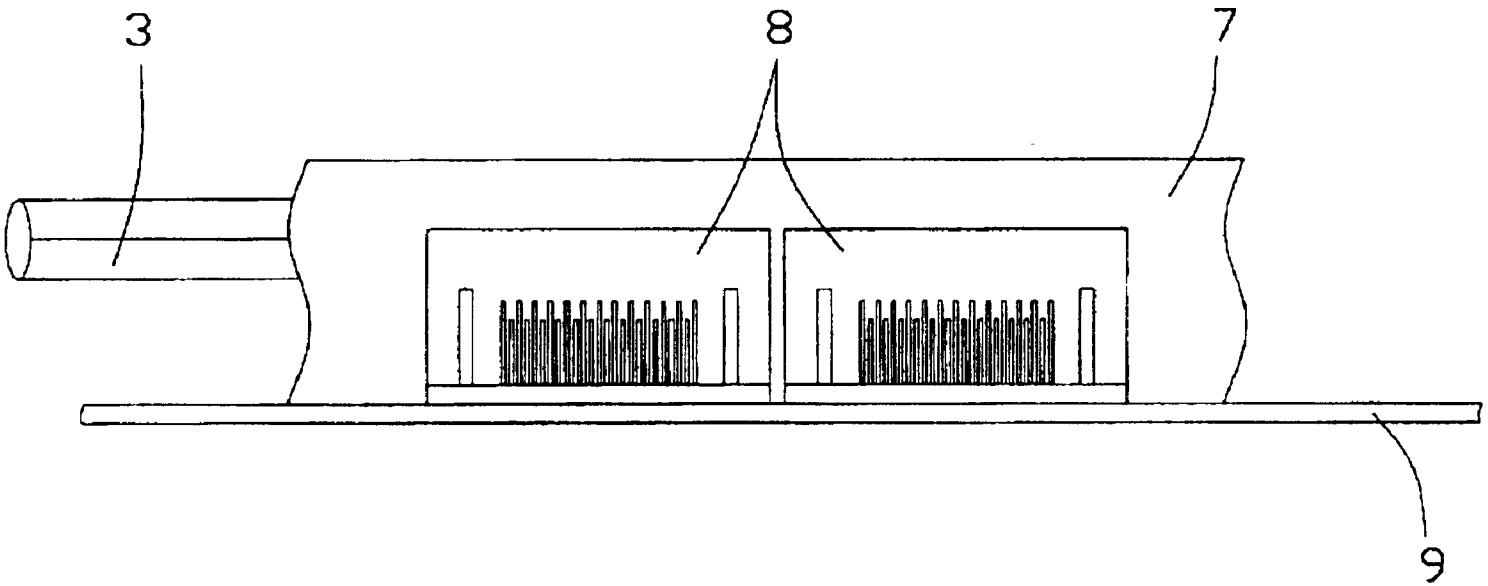
FIG. 11 is a planar view of an electronic card on which a pair of board mountable connectors are mounted to mate with the pair of cable connector assemblies behind the panel.
Figure 12:
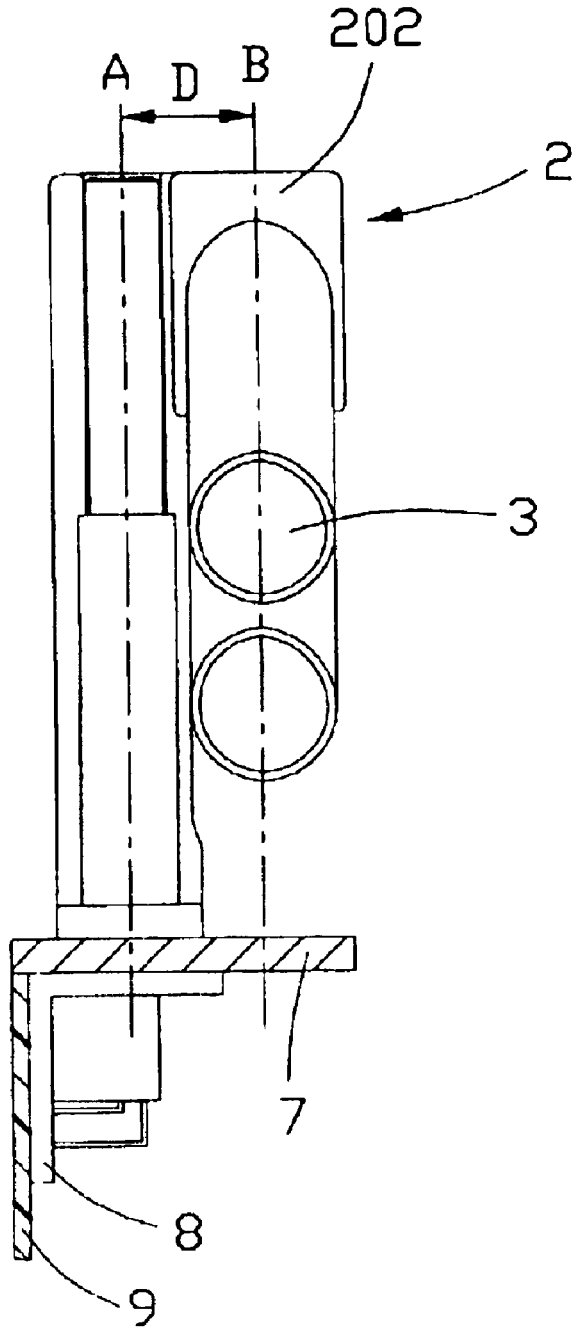
FIG. 12 is a lateral side view of FIG. 11 wherein the panel and the electronic card are cross-sectioned.

Turning to FIGS. 6 and 7, as is known in the art, the cable 3 includes a plurality of wires 30 (only two are shown) and a jacket 31 enclosing the wires 30. Each wire 30 is composed of a conductor 301, an insulating layer 302 surrounding the conductor 301, and a metal braiding 303 surrounding the insulating layer 302. Each terminal 21 of the cable connector 2 has one end soldered to a corresponding conductor 301 of a wire 30 and has the other end embedded in the mating tongue 22.

In assembly, a length of the jacket 31 is stripped from an end of the cable 3, and the end of the cable 3 is then received in the chamber 2021 through the opening 2022 with the wires 30 being received in the receiving space 2014. The individual wires 30 are stripped at an end thereof to expose a length of the conductor 301, and the conductors 301 are soldered to the corresponding terminals 21.

Figure 2:
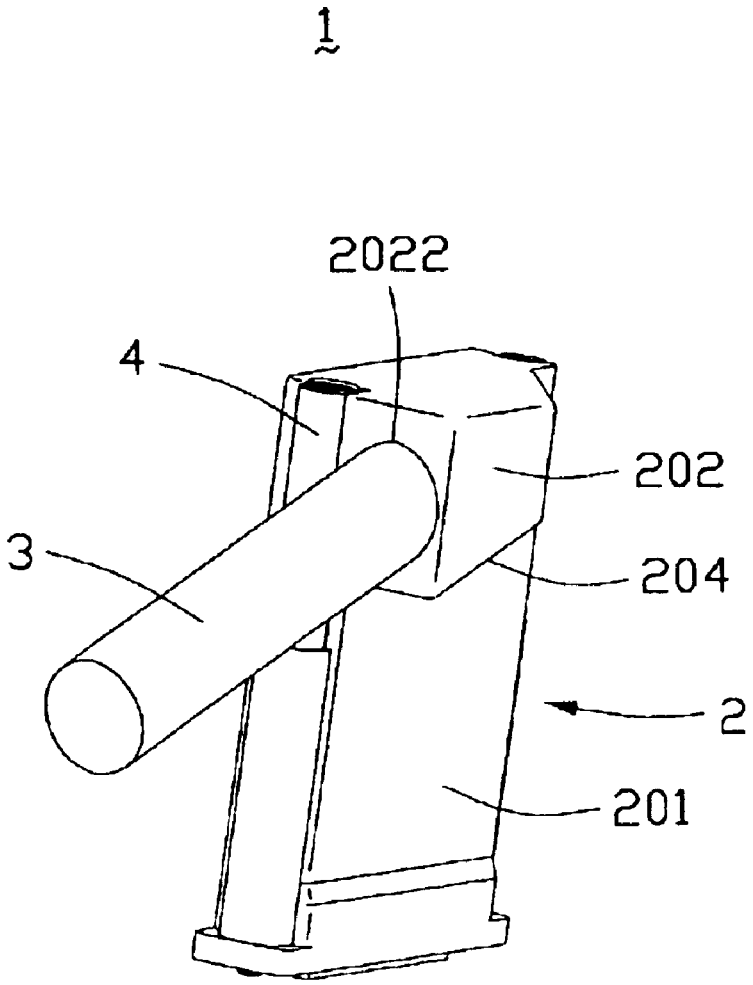
FIG. 2 is a view similar to FIG. 1 while viewed from a second direction.
Figure 3:
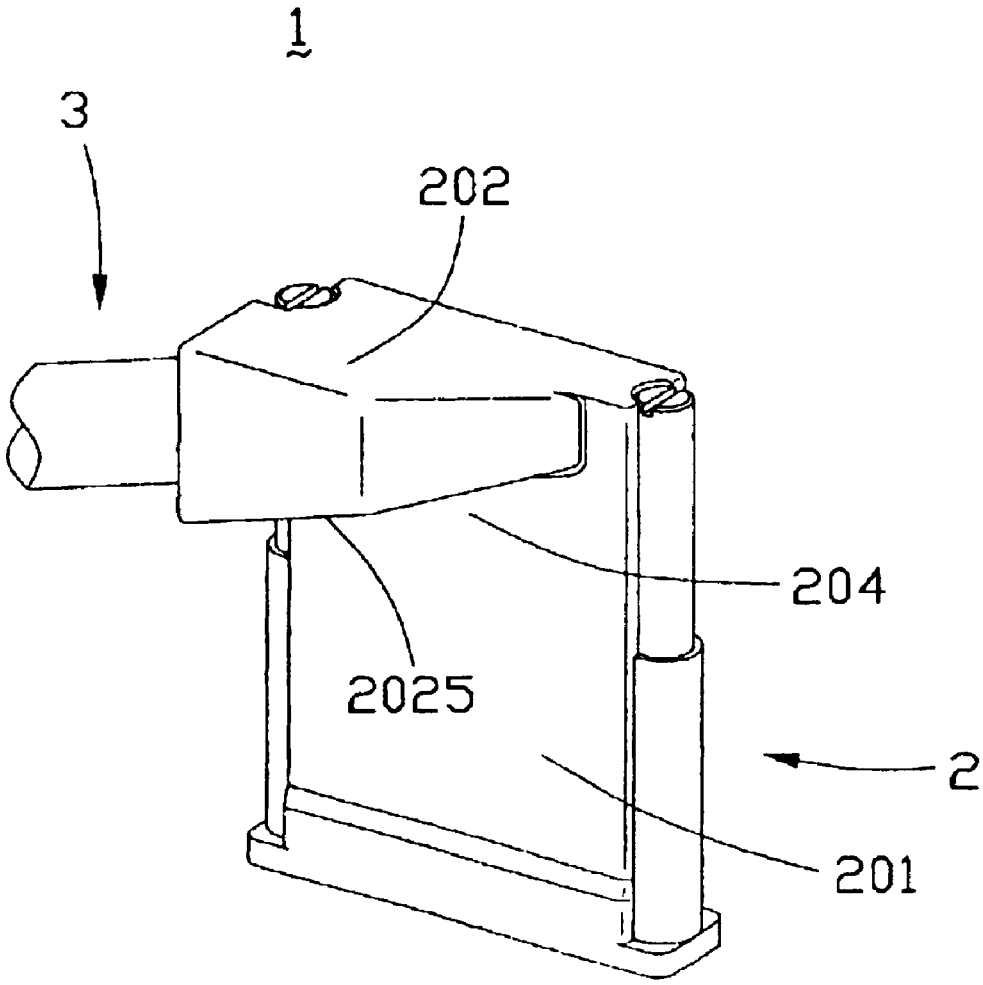
FIG. 3 is a view similar to FIG. 1 while viewed from a third direction.
Figure 4:
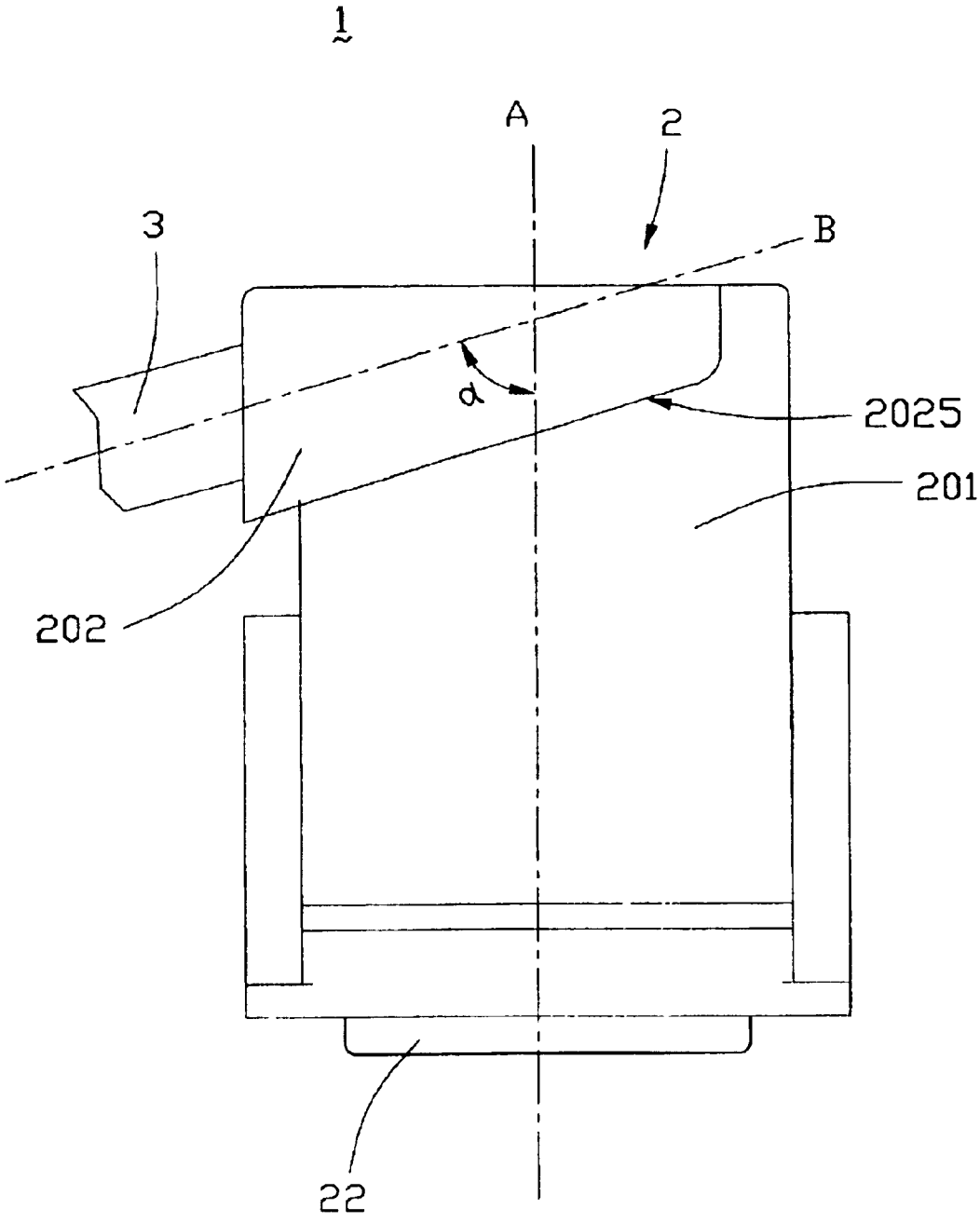
FIG. 4 is a top planar view of the connector in FIG. 1 with a pair of screws being removed therefrom.
Figure 5:
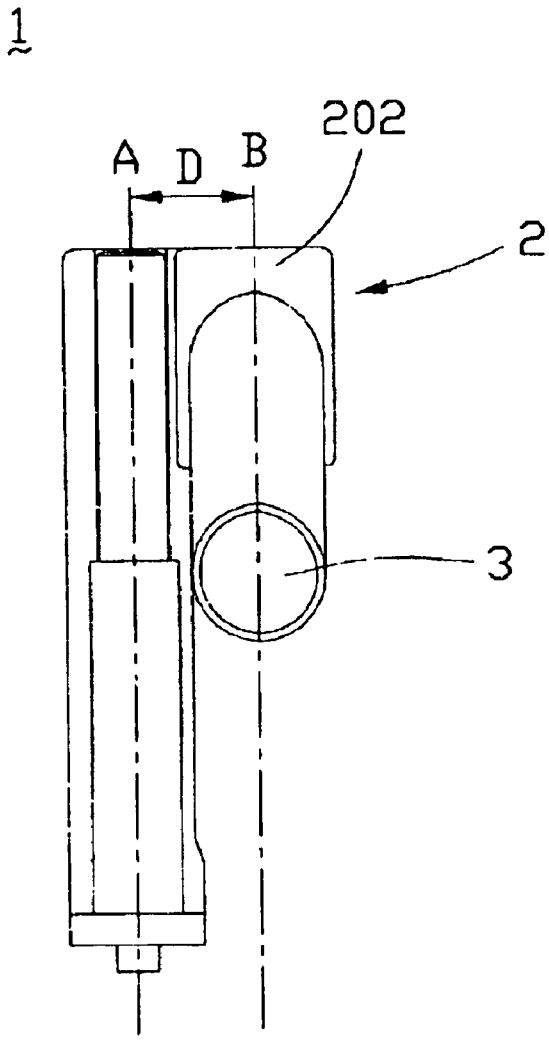
FIG. 5 is a lateral side view of FIG. 1.

R eferring back to FIGS. 4 and 5 in conjunction with FIGS. 1–3, the cable connector 2 has a central axis A, and the cable 3 attached thereto has a central axis B. The central axis A of the connector 2 forms an angle $\alpha$ with the central axis B of the cable 3, as shown in FIG. 4, and is downwardly offset from the central axis B a predetermined distance D, as shown in FIG. 5. The angle $\alpha$ is an acute angle and is approximately equal to an angle formed between the guiding face 2025 of the projecting portion 202 and the central axis A of the cable connector 2. It should be noted that the angle $\alpha$ is adjustable in practice to meet the special requirement of the extending direction of the cable 3. More over, it is obvious that a height of the projecting portion 202 is substantially larger than a diameter of the cable 3.

Particularly, FIGS. 8–15 introduce several applications of the cable assembly 1 of the present invention, which are respectively used in various circumstances. The details are given below.

Referring to FIGS. 8–12, the two cable connector assemblies 1 of the present invention are attached onto a side of a panel 7 side by side for mating with board mountable connectors 8 (FIGS. 11 and 12) respectively, the board mountable connectors 8 being secured to an opposite side of the panel 7 and terminated onto an electronic card 9. The cable 3 of one of the cable assembly 1 may exit from the cable exit channel 204 of the adjacent cable assembly 1, thereby occupying less space.

Figure 13:
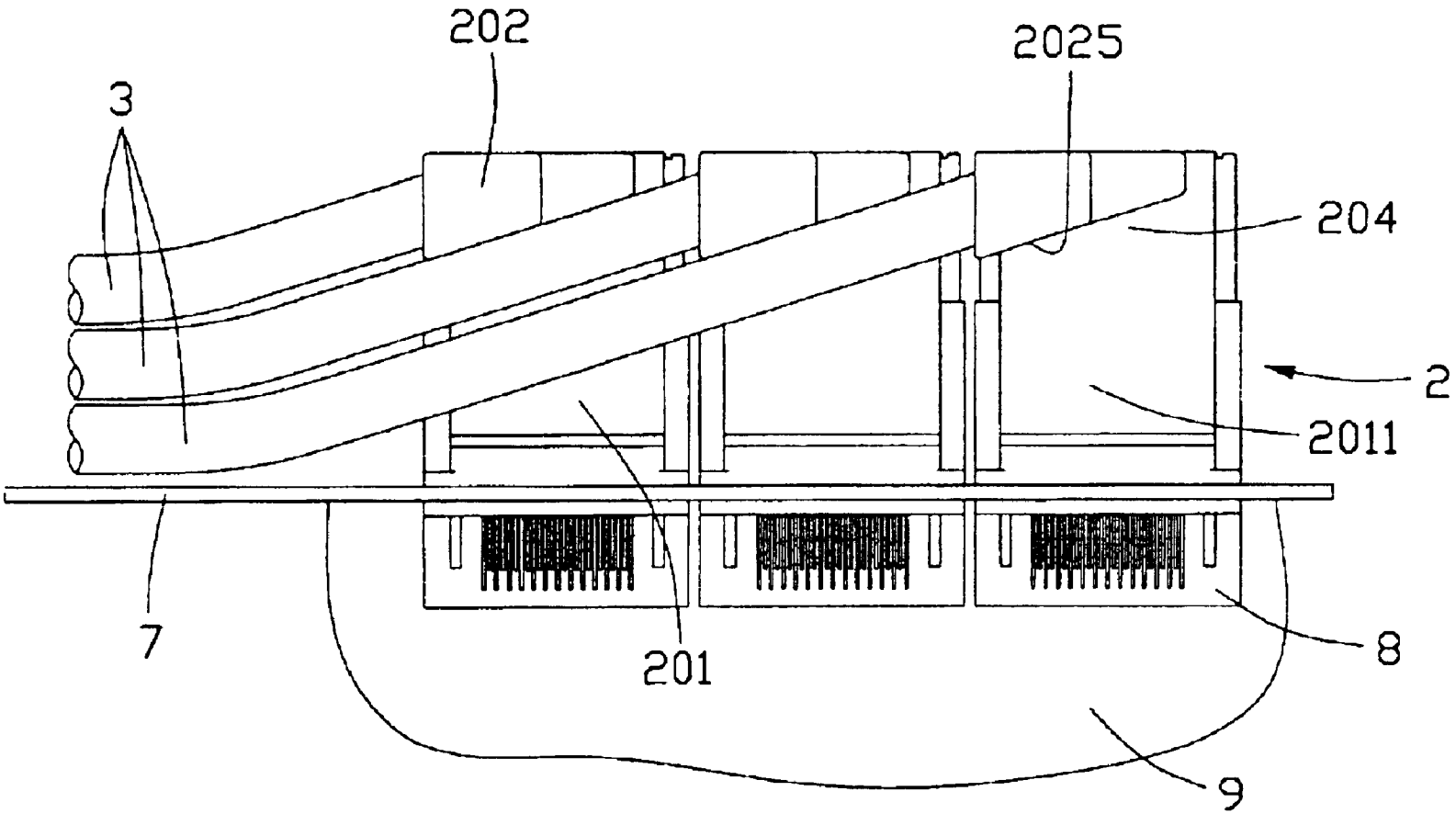
FIG. 13 is a top planar view of three of the cable connector assemblies secured to the panel and mating with three of the board mountable connectors on the electronic card.

FIG. 13 illustrates an application of three of the cable connector assemblies 1 in side by side relationship. In this embodiment, two cables 3 exit through the cable exit channel 204 of the third cable connector 2, thereby saving more space.

Figure 14:
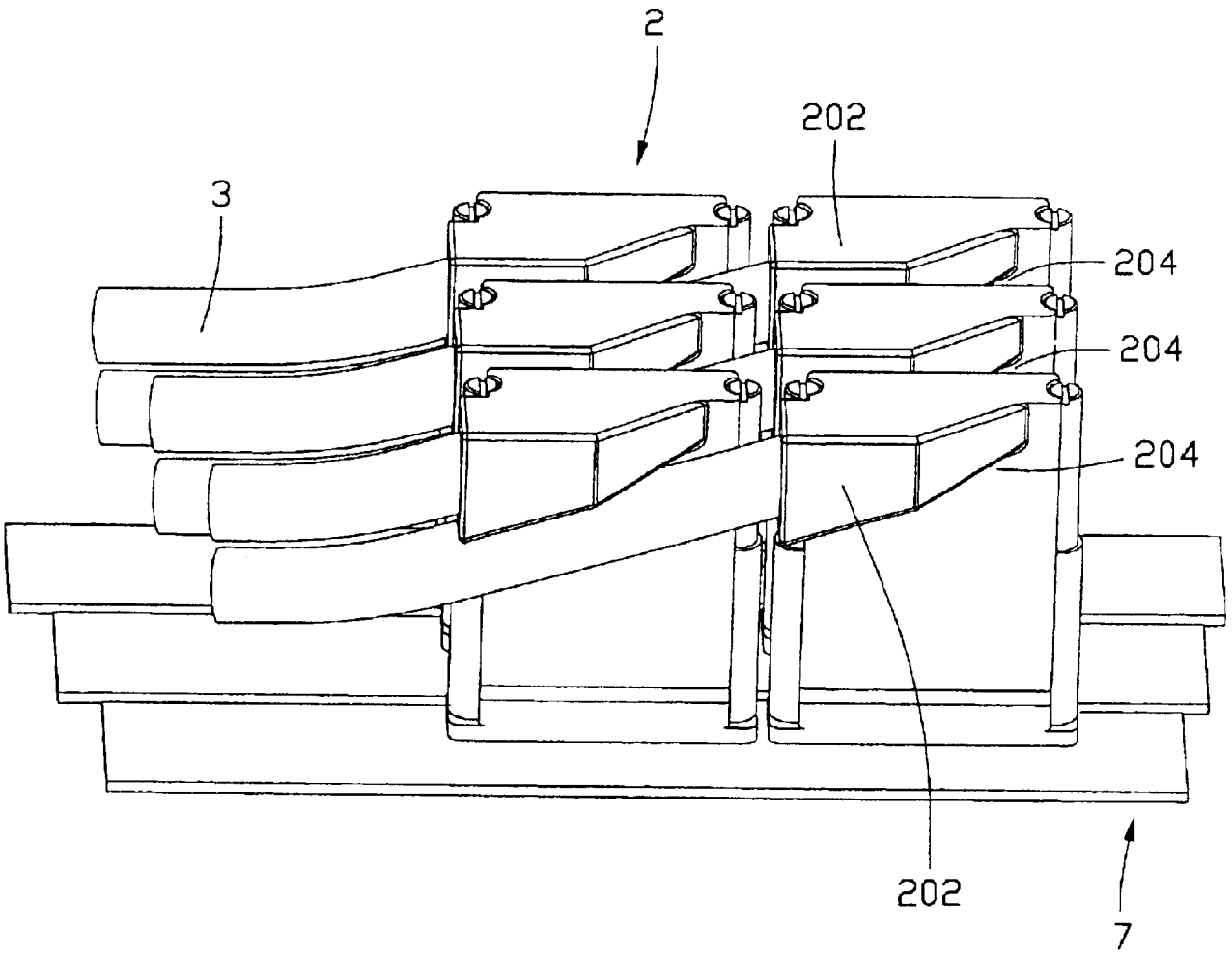
FIG. 14 is a perspective view of the cable connector assemblies and panels in a stacked arrangement.
Figure 15:
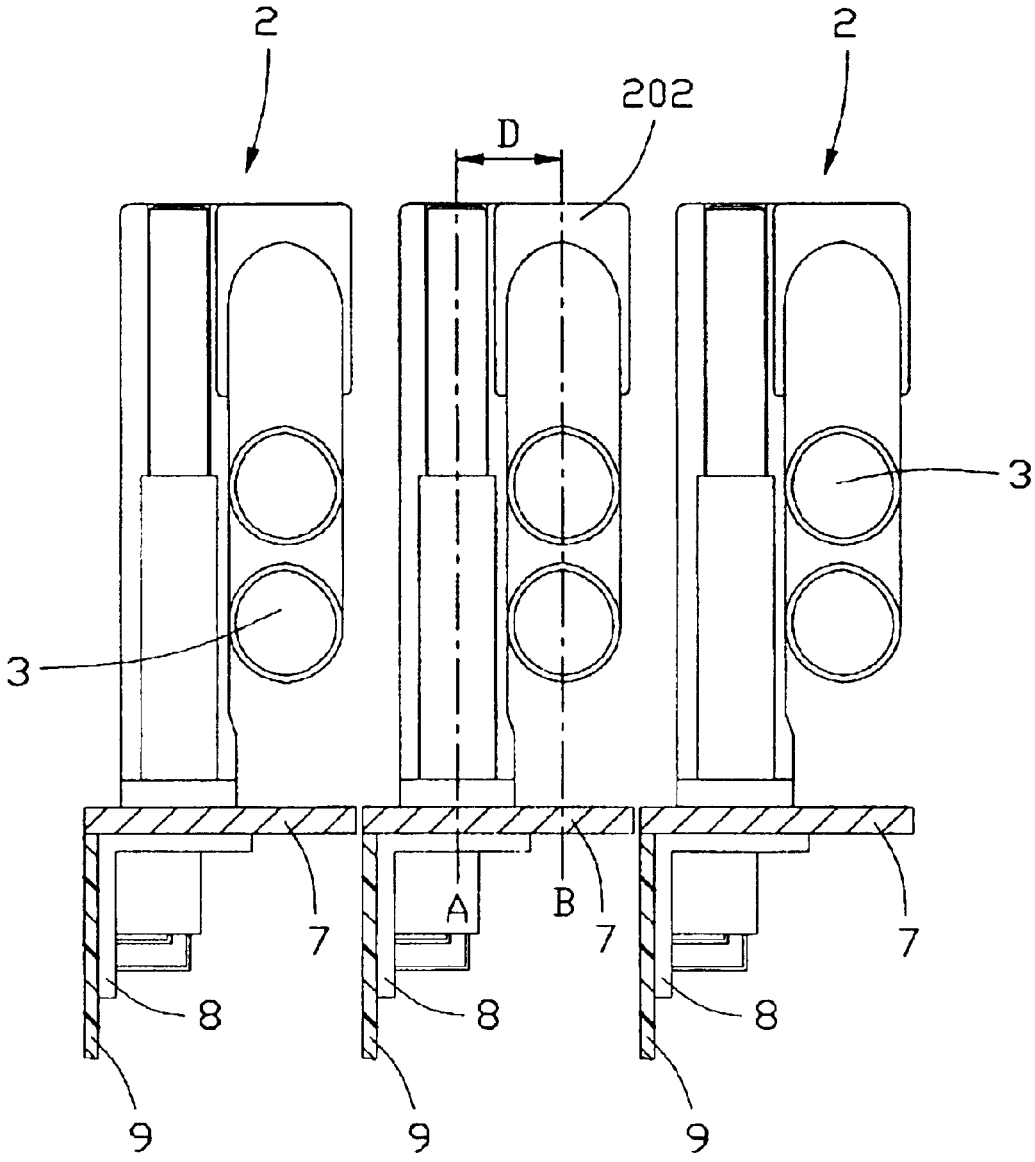
FIG. 15 is a lateral side view of FIG. 14 wherein the panels and the electronic cards are cross-sectioned.

Together referring to FIGS. 14 and 15, the two figures are present to show an application of a number of cable connector assemblies 1 arranged in columns and rows. It is clearly that none of the cables 3 interferes with the other cables 3 extending from nearby cable connectors 2, since a cable exit channel 204 and a projecting portion 202 of each cable connector 2 prevent such interference. Thus, the purpose of positioning a maximum number of cable connectors 2 in a designated, limited space on a panel 7 can be achieved. Furthermore, the cables 3 from the cable connectors 2 arranged in a same panel 7 will not interfere with other cables 3 from the cable connectors 2 arranged in adjacent panels 7 for all of the cables 3 extend parallel within a limited space protruded from their associated panels 7. Therefore, each panel is hot swappable, and adding, removing or swapping any panel cannot be interfered by neighboring cable connector assemblies which are mated onto the neighboring panels.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector system comprising:

a plurality of cable connectors each having a dielectric housing and a plurality of terminals mounted therein, the dielectric housing having a main body and a projecting portion protruding outwards from the main body, the projecting portion having a slanted, guiding face and a cable exit channel defined between said guiding face and said main body; end a plurality of cables each terminated with a corresponding connector and electrically connecting with the terminals;

wherein each cable exiting from its corresponding projecting portion of its corresponding cable connector extends along the guiding face of a next adjacent cable connector and is received in the cable exit channel of that adjacent cable connector, so that the plurality of cables exiting from the different cable connectors do not interfere with each other; wherein an opening is defined through a bottom side of the projecting portion of each of said connectors, through which one end of the corresponding cable is insertable into a receiving space of the corresponding dielectric housing.

2. The connector system as described in claim 1, wherein said plurality of connectors are side by side arranged with one another along a longitudinal direction of a panel.

3. The connector system as described in claim 1, wherein said cables commonly extend along a plane parallel to another plane on which said connectors commonly extend.

4. The connector system as described in claim 2, wherein each of said cables extends from the corresponding connector in neither a parallel direction nor a perpendicular direction relative to said longitudinal direction.

5. The connector system as described in claim 2, wherein a distance between the panel and the projecting portion is dimensioned to accommodate at least one cable therein.

6. The connector system as described in claim 2, wherein the cable extends angularly toward the panel.

7. The connector system as described in claim 3, wherein said plane and said another plane are not the same one.

* * * * *